US006235156B1

(12) United States Patent
Pullinen et al.

(10) Patent No.: US 6,235,156 B1
(45) Date of Patent: May 22, 2001

(54) METHOD FOR PAPER WEB TRANSFER AND TRANSFER APPARATUS FOR PAPER WEB

(75) Inventors: Hannu Pullinen, Riihimäki; Harri Kuosa, Järvenpää, both of (FI); Rauno Rantanen, Karlstad (SE)

(73) Assignee: Valmet Corporation (FI)

( * ) Notice: Subject to any disclaimer, the term of this patent is extended or adjusted under 35 U.S.C. 154(b) by 0 days.

(21) Appl. No.: 09/587,039

(22) Filed: Jun. 2, 2000

(30) Foreign Application Priority Data

Jun. 3, 1999 (FI) ..... 991267

(51) Int. Cl.[7] ..... D21F 1/36

(52) U.S. Cl. ..... 162/193; 162/255; 162/283; 242/532.7; 226/91

(58) Field of Search ..... 162/193, 194, 162/118, 255, 283, 286, 289; 242/532.7, 562.1; 34/117, 120; 226/89, 91, 92; 118/67, 68; 100/173

(56) References Cited

U.S. PATENT DOCUMENTS

| | | | |
|---|---|---|---|
| 3,355,349 | 11/1967 | Devlin | 162/286 |
| 4,648,942 | 3/1987 | Wanke et al. | 162/286 |
| 4,692,215 | 9/1987 | Kerttula | 162/289 |
| 4,728,396 | 3/1988 | Alheid | 162/193 |

FOREIGN PATENT DOCUMENTS

| | | | |
|---|---|---|---|
| 0332352 | 9/1989 | (EP) | D21G/9/00 |
| 0232689 | 6/1991 | (EP) | D21G/9/00 |
| 9713032 | 4/1997 | (WO) | D21F/7/00 |
| 9838382 | 9/1998 | (WO) | D21F/7/00 |
| 9854407 | 12/1998 | (WO) | D21F/7/00 |
| 9856701 | 12/1998 | (WO) | B65H/20/00 |

*Primary Examiner*—Stanley S. Silverman
*Assistant Examiner*—Eric Hug
(74) *Attorney, Agent, or Firm*—Steinberg & Raskin, P.C.

(57) ABSTRACT

In the method for paper web transfer in a paper machine or finishing apparatus for paper, a paper web (W) is transferred in a first machine portion (A) at a first travelling speed. In a second machine portion (B) following the first one in the travel direction of the web, the tail is transferred at a travelling speed lower than the first travelling speed. In the second machine portion (B) the tail (TB) is transferred independently without a draw connection to the web (W, TA) transferred in the first machine portion (A), the travelling speed of the tail (TA) transferred in the second machine portion (B) is increased, and a draw connection is established between the tail and the web (W, TA) transferred in the first machine portion.

14 Claims, 4 Drawing Sheets

VI - VI

METHOD FOR PAPER WEB TRANSFER AND TRANSFER APPARATUS FOR PAPER WEB

FIELD OF THE INVENTION

The present invention relates to a method for transferring a paper web in a paper machine or finishing apparatus in which in a first portion of the paper machine the web is transferred at a first traveling speed and in a second portion of the paper machine a tail is transferred at a traveling speed lower than the first traveling speed. The present invention also relates to an apparatus for transferring a paper web in a paper machine or finishing apparatus which is adapted for transferring the web in a first portion of the machine at a first traveling speed and a section portion of the machine is adapted for transferring a tail at a traveling speed lower than the first traveling speed.

BACKGROUND OF THE INVENTION

After a stoppage or web break in a paper machine or a finishing apparatus for paper, the web has to be made to travel along a path according to the web path geometry again. In order to make a web of several meters in width to travel along a route according to the web path geometry, which can be quite complex in some sections, a tail or a lead-in-strip, which is narrower than the full-width web, is first guided to travel a given distance in the machine direction. There are several auxiliary devices developed for tail transfer, such as suction belts and air blowing devices that convey the strip, and threading ropes or belts between which the leading end of the tail is guided. The transfer distances of such auxiliary devices from the reception point to the delivery point vary in length. As for the numerous methods, examples that can be mentioned include e.g. the rope-assisted threading presented in the international publication WO 97/13032 by the applicant, and the short transfer of the tail implemented by means of a suction belt, disclosed in the U.S. Pat. No. 4,692,215 by the applicant. The Finnish patent 101634 by the applicant, and the corresponding international publication WO 98/38382, in turn, disclose threading through a stack of calender rolls conducted by means of air blowings and suctions. The tail can also be transferred by means of combinations of different devices through a given portion of the machine, i.e. a particular distance along the travel path of the web from the starting point to the end point. As for the different threading methods, reference can be made to the publications U.S. Pat. No. 3,355 349, EP-232 689, U.S. Pat. No. 4,648 942 and EP-332 352.

According to the established practice, the tail is transferred at the running speed of the machine. Thus, on a given portion of the paper machine or finishing machine for paper, a full-width web is passed to a broke processing system at the production speed, and a narrower tail or lead-in-strip is separated e.g. from one edge of the web by means of a suitable cutting method. This tail is transferred in any of the aforementioned ways or by means of a combination of the same, through the next portion at the same running speed, which is at present typically over 20 m/s. When the web has been passed without problems through this portion in which the web path geometry can be quite winding and the tail is passed between several members located close to each other, the web is spread into its full with by means of diagonal cutting.

The significance of a fast threading process is emphasized for example in the U.S. Pat. No. 4,728,396, which discloses threading through a coater. Here, the threading of the web is first conducted at a speed lower than the running speed (production rate), i.e. at a so-called crawling speed, starting from the unwind stand in the inlet end of the machine. However, if a web break takes place, the web is still passed at the production speed to the broke processing system in a point located before the web break point in the travel direction of the web, and a tail is separated from this web and passed through the coater at the running speed, whereafter it is spread into a full-width web travelling at the running speed i.e. at the production speed. This decreases idle time in connection with web breaks, because the speed of the machine does not have to be reduced for threading.

High threading speeds improve efficiency, but at the same time it is necessary to be able to control the tail in threadings in which the web possibly travels even over steep curves due to the winding or meandering nature of the web path geometry, and through narrow points in the travel path, for example between two obstacles located close to each other, of which obstacles one or both can be a rotating roll. Because of this, auxiliary members have been developed which move at a speed lower than the threading speed, and at the same time receive the tail passed at a threading speed corresponding to the running speed while moving to the threading direction. As an example of this can be mentioned the suction tube presented in the international publication WO 98/56701, which receives the tail, at the same time moving to the threading direction at a speed lower than the running speed of the tail. Thus, a special device, which must be moved within the entire threading distance, is required to ensure the travel of the tail.

The Finnish patent 102197 by the applicant, and the corresponding international publication WO 98/54407 also disclose a manner in which it is possible to attain a speed of the tail, which is lower than the running speed without having to change the running speed of the machine portion preceding the threading portion. The idea is based on the mechanical working of the tail in such a manner that its free length is reduced, wherein the threading devices, such as ropes, functioning along the threading portion, can transfer the tail at a speed lower than the running speed. In this method, the reduction of the speed is directly dependent on how well the tail can be shortened for example by wrinkling and the speed has to be adjusted to comply with the change of length of the tail.

OBJECT AND SUMMARY OF THE INVENTION

It is an aim of the invention to introduce a method, which substantially differs from the previous ones, and by means of which it is possible to adjust the threading speed freely, irrespective of the running speed or the measures possibly exerted on the tail before the threading portion. In the travel direction of the web, the tail transferred in the second machine portion following the first machine portion operating at the running speed is, in view of speed adjustment, a web separate from the web passed along the first machine portion, without draw connection to said web passed at the running speed. This enables the adjustment of the threading speed to a suitable level, and when the threading is conducted through the portion at the threading speed, the speed of the tail is increased in this portion, and the draw connection is arranged between the tail travelling along the threading portion and the web travelling in the preceding portion, especially web part, i.e. tail which is narrower than the full-width web. The draw connection is attained for example by splicing the web passed at the running speed to the tail which before that has been accelerated to the running speed in the threading portion.

Without restricting the invention in any way, it can be stated that it is advantageous to conduct the threading in the second portion at a speed which is considerably lower than the normal running speed, for example at a speed which is 75% of the running speed at the most, advantageously 50% of the running speed at the most.

The tail which is transferred independently in the threading portion, can be discharged from a storage, which is for example a sufficiently long paper strip wound on a reel, which paper strip is narrower than the full-width web and has been separated in the same mill in a section of another paper machine or finishing apparatus for paper or in a section of the same paper machine or finishing apparatus for paper, for example from the edge of the web in connection with the production run. Thus, the used strip can be pulped and it can be directed to a pulper or a corresponding broke processing system in the end of the threading portion. The tail can also be arranged as an endless loop, which travels through the machine portion and returns from the end point to the starting point. This loop can be of paper, and thus it can be reused, i.e. pulped. The tail can also be of another material, the durability of which allows it to be used again. This kind of tail can also be first passed from the reel or as a loop at a lower speed through the threading portion.

To splice the tail separated from the web and travelling at the running speed in the preceding portion, to the tail discharged from the storage, it is possible to use suitable solutions by means of which the leading end of the web can be attached at high speed to the web discharged from a reel or the like, and the splicing devices can thus comprise a glueing device, by means of which at least one of the webs can be provided with an adhesive surface, and a pressing device by means of which the surfaces of the webs to be joined together can be placed against each other.

Other preferred embodiments of the invention are described in the appended dependent claims and in the description hereinbelow.

BRIEF DESCRIPTION OF THE DRAWINGS

In the following, the invention will be described in more detail with reference to the appended drawings in which.

DETAILED DESCRIPTION OF THE PREFERRED EMBODIMENTS

Figure 1:
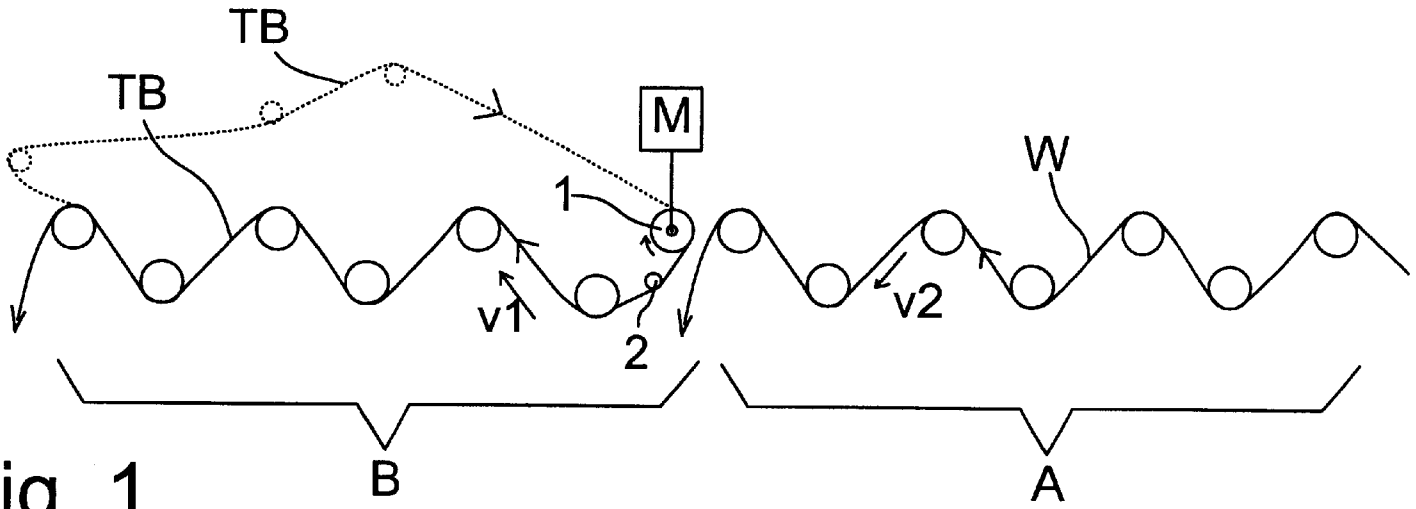
FIGS. 1 to 3 illustrate the principle of the method according to the invention schematically.

In FIG. 1 the first machine portion in the longitudinal direction, i.e. machine direction of a paper machine or a finishing apparatus for paper is marked with a letter A. The portion is shown quite schematically and basically it can be any section in which the web W is transferred along a travel path, which follows a more or less tortuous or meandering route in accordance with the web geometry. In the travel direction of the web W, a portion can be defined as a section of a particular length of the machine or apparatus. As a result of threading, which has been implemented earlier, the paper web W has been made to travel over this portion, which threading may have been implemented either at a speed lower than the normal running speed or at the running speed, depending on the situation of the process. In the end point of the portion A, the full-width web W is passed to broke for example down to a pulper. In solutions of prior art, a narrower tail or lead-in-strip would be separated from the web W travelling along portion A, and the tail would be guided at the same running speed through the following portion B by utilizing suitable auxiliary devices, whereafter the tail would be spread to form a full-width web. In the case shown in FIG. 1, at the same time when the full-width web W is passed to broke at the running speed i.e. production speed, a tail TB separate from this web is guided in the travel direction of the web through the second portion B following the first portion A at a speed v1, i.e. crawling speed, which is clearly lower than the speed v2 of the paper web W passed to the end of the portion A. The tail TB is supplied close to the point where the web W is passed to the pulper. When the tail TB has been made to travel through the portion B, it is accelerated according to FIG. 2 up to the same web speed v2 as the full-width web W travelling in the preceding machine portion A. After the tail has been accelerated to the running speed v2, at the latest, the next step is to start separating a narrower tail TA from the web W in the cross-machine direction at the same point where the separate tail or lead-in-strip TB travels, i.e. the tails are substantially aligned, but at that moment they are separate from each other without a mutual draw connection. The narrower tail separated from the web W travelling in the first portion A continues to be guided with the web W to broke.

Figure 3:
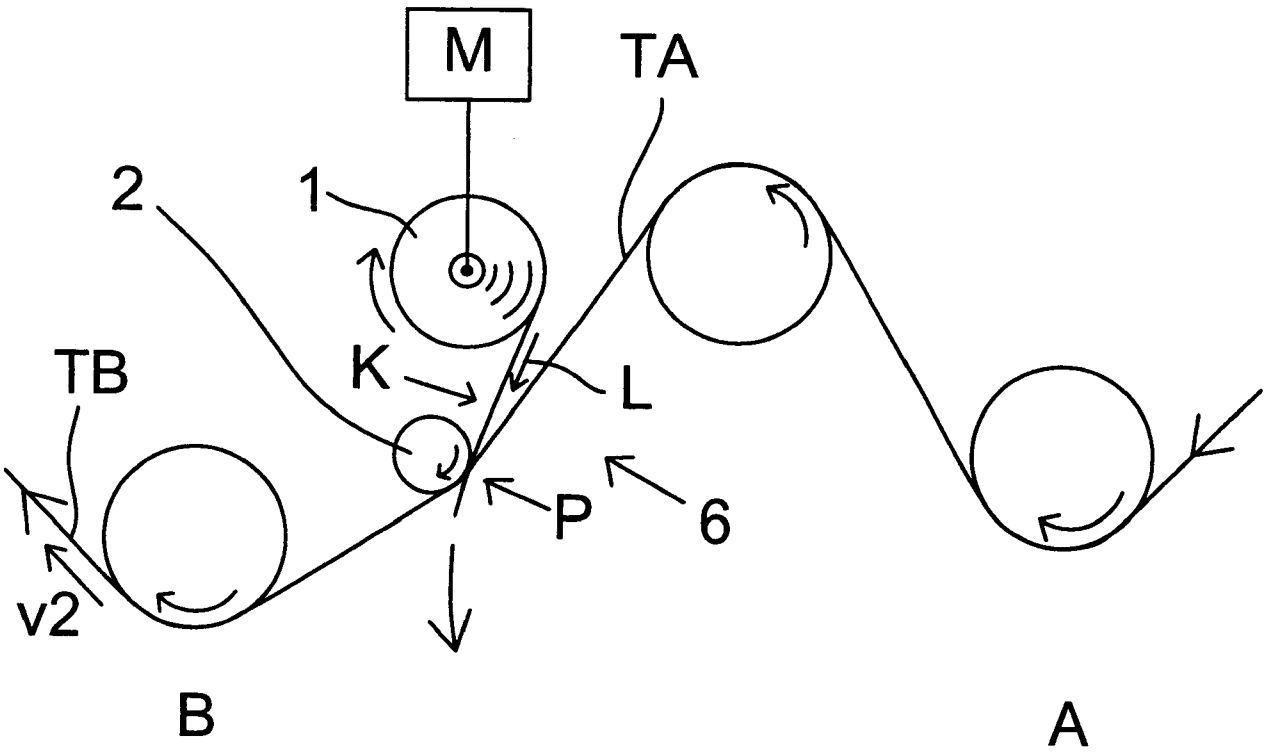

FIG. 3 shows a stage in which a draw connection is arranged between the tail TB accelerated to the running speed v2 and the tail TA issuing from the first portion. The draw connection is attained by splicing the tails one after the other to each other, wherein the tail TB draws the following tail TA separated from the full-width web W through the portion B, and thereafter the situation is the same as in normal threading processes, i.e. the tail TA separated from the full-width web W travels through the next portion B at the running speed v2, whereafter the tail TA can be spread to form a full-width web W for example by means of diagonal cutting by transferring the member separating the tail in the cross-machine direction. Thereafter the full-width web W travels both through the portion A and the portion B at the running speed v2. It is possible that still a new threading portion succeeds the portion B. The tail TA separated from the full-width web W and the full-width web W are passed to broke in the end of the portion B, and in the next portion the threading can be implemented either in the conventional manner or by using the method according to the invention also in this next portion. In the latter case the next step is to start running the independent tail at a suitable stage through the next portion at a speed lower than the running speed v2, at the same time when the full-width web W is passed at the running speed v2 to the broke processing system in the end of the portion B.

Figure 2:
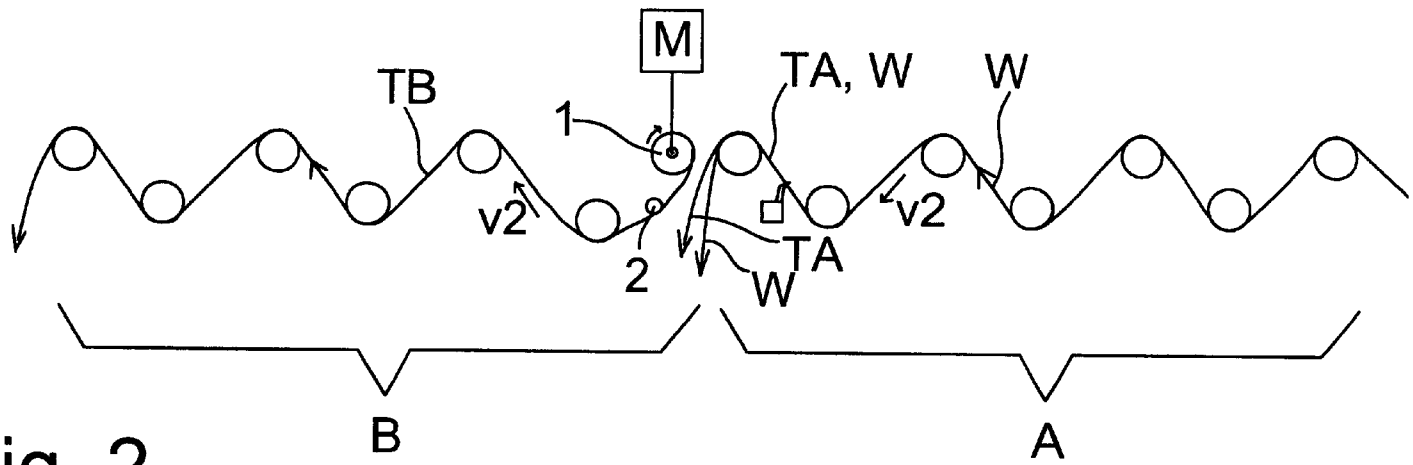

In the following, the threading apparatus and its parts will be described. As can be seen in FIGS. 1 to 3, the tail, which is passed at a lower speed, is discharged from a suitable storage 1, which can be for example a reel. To rotate such a reel in the unwinding, it is possible to utilize a motor M, and the discharge device contains one or more guiding rolls 2 or corresponding guiding means to guide the tail TB to run on the same line with the tail TA passed from the first portion A. The discharge device functions by means of speed adjustment when the tail TB is transferred at the crawling speed v1. To facilitate the act of joining the tails to each other they are guided to the same direction sufficiently close to each other. Furthermore, the apparatus contains a splicing device 6 by means of which the tail TA passed from the preceding portion A can be attached to the tail TB at full speed for example by means of a glue spreading (arrow L) and a member (arrow P) that presses the tails or strips against each other, and this device advantageously also contains a cutting member (arrow K) to cut the tail TB discharged from the storage 1 at a location after the joining point. In the operation of the splicing device it is possible to apply principles used in the continuous unwinding of the paper web (cutting+splicing stroke), by means of which the webs passed from the reels for example to the coating machine are attached to each other at high speed.

It is also possible to transfer the narrower tail TB through the portion B as a loop. In the loop, the tail returns to the starting point in the end of the portion B. FIG. 1 illustrates this alternative schematically with a broken line. Such a loop, which is also composed of pulpable paper, is threaded in an open state through the portion B at low speed, and a closed loop is formed thereof by joining the ends of the tail to each other, and this loop is then run at a speed v1 lower than the running speed v2, whereafter the speed is accelerated up to the running speed and the tail TA issuing from the first portion A is spliced thereto. At the same time the loop can be cut in the beginning or in the end of the portion B so that the tail can be guided to the correct point for example into broke in the end of the portion B. Alternatively, the loop is only cut at one point in the end of the portion B and the trailing end in the return portion of the loop travels through the portion together with the tail TA.

The separate tail TB which is guided through the second portion B at its own speed can be manufactured of discharge paper produced by a paper machine or a finishing machine for paper in the same mill, for example from paper cut off from the edge of the paper web during the production run. This paper strip can also originate from the same machine in which the threading is conducted. Such a cut-off paper which is suitable in width in view of the threading (for example a strip of under 50 cm in width) can be wound on a reel simultaneously, and the reel is transferred to the threading device before starting the threading.

Correspondingly, in forming the loop it is also possible to utilize the paper manufactured in the same mill, which can also be a strip separated from the edge of the full-width web travelling in the process.

When the tail is of paper, its fibrous raw material can be reused by running the paper to the broke processing system, the purpose of which is to recycle the raw material so that it can be used again in the papermaking process.

It is also possible that the tail is made of material, which is different from the material, which can be pulped and used again in the production process of the same mill. For example, the tail can be a plastic film or the like, with sufficient tensile strength. It can also be based on other fibres than cellulose fibres, for example a nonwoven fabric made of synthetic polymer fibres. Such a tail can be rewound in the end of the threading portion, or it can be used as a loop. Thus, after the threading portion B, a paper tail TA has to be separated from the loop-like nonpulpable tail, so that it can be passed to the broke processing system.

Figure 4:
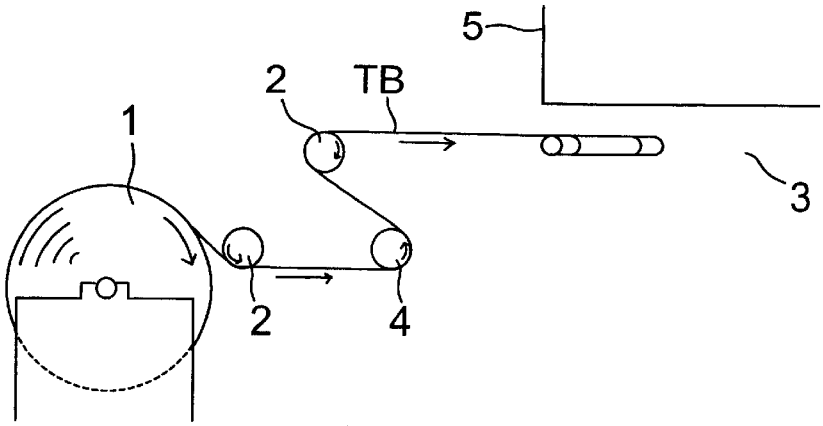
FIGS. 4 to 6 illustrate the act of applying the invention in the end of the drying section.
Figure 5:
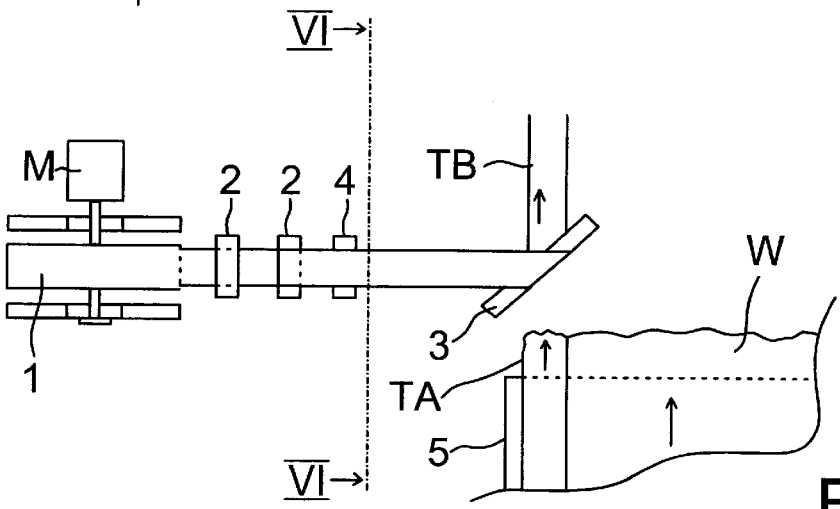
Figure 6:
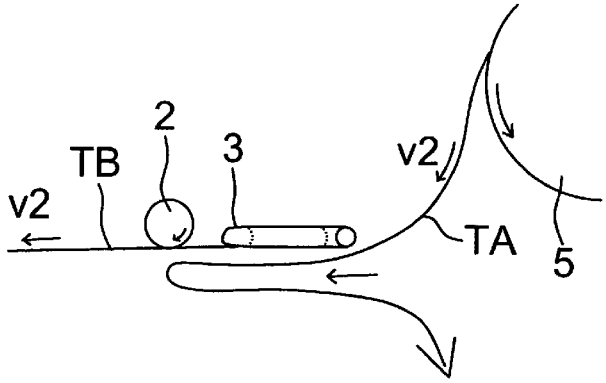

FIGS. 4 to 6 show an apparatus according to the invention in the end of the drying section. The tail is in the storage 1 wound on a reel, which is located outside the edge of the web on the tending side of the paper machine, i.e. the reel or a corresponding storage 1 does not have to be aligned with the machine as shown in FIGS. 1 to 3. From the reel the tail TB is discharged via the guiding rolls 2 to the turning device 3, which turns the tail travelling towards the machine in the cross-machine direction. This turning device 3 can be a reversing roll or the like, for example a stationary tube, which is placed diagonally. The turning device can be connected to a pressurized air network, wherein a layer of air is generated between the turning device and the tail, and it is thus even capable of guiding a strip-like tail discharged at high speed. Thus, the turning device 3 guides the tail TB to travel along the edge of the web in the machine direction, close to the last drying cylinder 5 of the drying section. The tail TA which is passed to broke after the last drying cylinder can be passed closer to the second tail TB by means of blowings, and the splicing can be conducted in a similar manner as described above. The discharging device also contains a tension measurement roll 4 for tension adjustment during the threading. To ensure the discharge of the tail even at high speeds, the reel is arranged to be rotated by means of a motor M coupled to its shaft.

Such an alternative is also possible in which the splicing nip is separate after the roll 2 in the travel direction of the tail TB. Thus, the tails can be made to travel together after the roll 2 along the area where the splicing nip is located, for example by means of blowings or other guiding devices.

Figure 7:
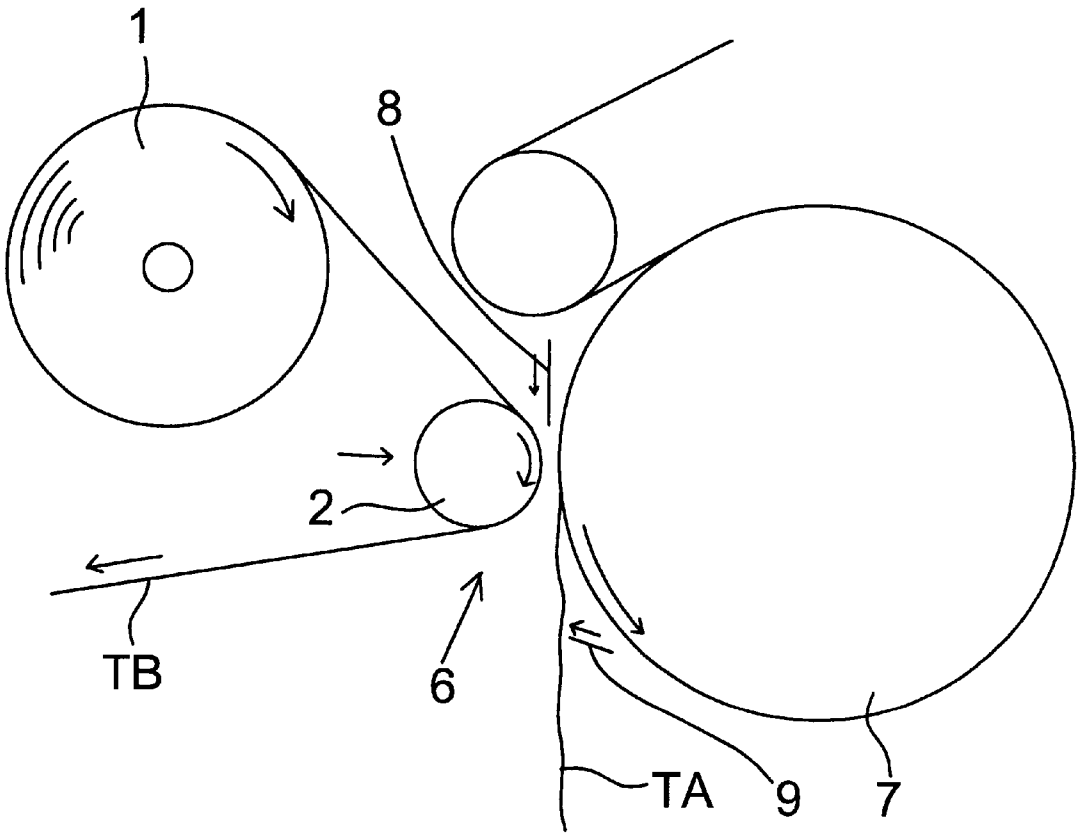
FIG. 7 shows a manner in which the tails can be attached together.

FIG. 7 shows the splicing device 6 on a larger scale. The lead-in-strip reel 1 is placed after the last cylinder 7 of the group of drying cylinders in the drying section. The size of the strip reel is dimensioned in such a manner that there is a sufficient amount of strip on the reel for threading through the portion B. Near the cylinder 7, along which the tail passed at the running speed travels e.g. to the broke processing system, there is a guiding roll 2 which at the same time functions as a splicing roll and provides a splicing nip. The roll 2 is movable in such a manner that it is capable of striking the tail TB guided from the reel 1 towards the threading portion B by the periphery of the roll 2 against the tail TA which travels along the mantle of the drying cylinder 7. The splicing of the tails TA and TB travelling at the same speed thus takes place against the drying cylinder 7. In FIG. 7, reference numeral 8 indicates a two-sided splicing tape, for example a paper-based adhesive tape which is placed in the splicing nip from above at the splicing stage. The tape 8 is pressed between the tails TA and TB in the nip, thereby joining the tails together. A cutting device 9 is also designed to function at the splicing moment, said cutting device cutting the tail TA travelling freely underneath the splicing nip down to the broke processing system.

Alternatively, the splicing can be conducted with a glue injector L (see FIG. 3), which is directed between the tails on the entrance side of the nip in a similar manner as the tape 8.

The above-described machine portions A and B that convey the paper web can be any portions following each other in the machine direction and having a particular length in the travel direction of the web, and they can both contain several functional devices which treat the paper web W. The first portion A can be for example a drying section or be consisted of one or more drying groups of the drying section, and the second portion B can be a calender with several nips, for example a 2-nip soft calender or a multinip calender in which the nips are formed between calender rolls placed on top of each other in a stack, wherein the tail TB is guided along a winding path through successive roll nips. The portion B can also comprise several devices; it can for example comprise other devices in addition to the calender, e.g. both the calender and the reel-up following thereafter, wherein the threading at the crawling speed can be conducted through the calender all the way to the reel-up by using the tail TB. Furthermore, it is possible that the first portion is a press section and the second portion B is constituted of one or more groups of drying cylinders in the drying section following the press section. The portion B can also be a device for treating paper web surface located between two groups of drying cylinders, such as a coating station or a size press. It is also possible that both portions A and B comprise drying cylinders of the drying section. The first portion A can for example comprise one or more drying cylinder groups, and the portion B located thereafter can comprise one or more drying cylinder groups, i.e. the method can be used for transferring the tail at a lower crawling speed through one or more drying groups. In general, the method is applicable in all successive machine sections and groups, which are provided with separate drives for running the sections or groups at different speeds.

Correspondingly, the invention is applicable to use in an off-line coating machine or in an off-line calender, and in general in all such machines that treat the paper web to adjust its properties to comply with the purpose of use of the paper and which can be provided with two successive portions, the latter of which can be utilized to pass the tail by means of a separate drive of the members guiding the web at a speed lower than the running speed of the web/tail in the preceding portion.

The tail TB guided along the second portion B can also be produced from the wide web W issuing from the first portion at running speed by means of suitable arrangements, for example in such a manner that the tail TA is separated therefrom, said tail being used as the tail TB passed at a lower speed. The tail is thus not passed to broke. Because the tail constantly accumulates between the portions at the speed v2–v1 because of the differences in speed, the portions have no draw connection even if they were integral with each other. It is also possible to accumulate a suitable amount of the tail TA passed at the running speed v2 on a reel or to another form that can be controlled, to cut the tail, and to guide the rest of the tail to broke as usual. Thereafter, it is possible to start the transfer of the accumulated tail to the second portion B at the crawling speed v1.

In particular, the invention is suitable for the transfer of a web which is narrower than the full-width web, typically under 50 cm, but the invention does not exclude the possibility that a full-width web is passed through the second portion at crawling speed, said web functioning as a tail in this case, to which the full-width web W is spliced at full speed by the "flying splice" technique. This embodiment is suitable for machines in which the running speeds are not high and/or in which the machine widths are not large.

The strip-like tails TA and TB, which are narrower than the full-width web, can be located either on the edge of the web or closer to the middle. For example the tail TA passed from the drying group of FIG. 7 can be a tail shifted towards the middle of the web by means of so-called dual cutting, wherein the reel 1 is also placed in the corresponding area in the cross-machine direction of the web. Similarly, in the embodiments of FIGS. 4 to 6, it is possible to guide the tail TB passed from the side to a point corresponding to the point of location of the tail TA which would be in the middle portion rather than in the edge of the full-width web.

The invention does not require any changes to be made in the auxiliary devices of the threading, but it is possible to use known principles therein to guide the tail. Because the leading end of the tail is transferred at low crawling speed and the tail is not accelerated up to the running speed until it travels through the entire portion B, it is in fact possible to use less complicated methods and auxiliary devices which do not require as high performance as before.

In this context, the concept of paper web refers to continuous materials transferred in all machines for manufacturing web-like, paper-based material and in finishing apparatuses of the same, which materials are made of fibrous pulp and which, thanks to their flexibility, can be transferred along a winding or tortuous path. The invention is not restricted to paper grades within certain basis weight area, but the scope of the invention also covers paperboard grades the threading of which can be implemented in the above-described manner.

What is claimed is:

1. A method for transferring a web in one of a paper machine and a finishing apparatus for said web, the method comprising the steps of:

transferring a paper web in a first machine portion of the one of said paper machine and said finishing apparatus at a first traveling speed;

transferring a separate tail in a second machine portion of the one of said paper machine and said finishing apparatus located after said first portion at a second traveling speed which is lower than said first traveling speed;

wherein in said second machine portion said tail is transferred independently without a draw connection to said web transferred in said first machine portion;

increasing the traveling speed of said tail portion; and establishing a draw connection between said tail and said web.

2. A method according to claim 1, further comprising the step of discharging said tail from means for storing said tail prior to transferring said tail through said second machine portion.

3. A method according to claim 2, wherein said means for storing said tail is separate from the web transferred in said first machine portion.

4. A method according to claim 2, wherein said means for storing said tail is a reel.

5. A method according to claim 1, wherein said step of transferring a separate tail in a second portion comprises transferring said tail in said second machine portion as an endless loop.

6. A method according to claim 1, wherein said tail transferred in said second machine portion is a strip narrower than the web.

7. A method according to claim 1, wherein said establishing a draw connection between said tail and said web comprises splicing said tail to said web.

8. A method according to claim 7, wherein said splicing step is performed by passing said tail and said through a nip defined by a first roll guiding said web and a second roll guiding said tail.

9. An apparatus for transferring a paper web in one of a paper machine and a finishing apparatus for said paper web, said apparatus comprising:

a first machine portion structured and arranged for conveying a paper web at a first traveling speed;

a second machine portion arranged after said first machine portion in a travel direction of the web for conveying a tail, said second machine portion is structured and arranged for conveying said tail at a second traveling speed lower than said first traveling speed;

wherein said tail transferred in said second machine portion is transferred without a draw connection to the web transferred in said first portion; and means for connecting said tail to said web to establish a draw connection therebetween.

10. The apparatus according to claim 9, further comprising means for storing said tail and means for discharging said tail from said means for storing into said second machine portion.

11. The apparatus according to claim 9, wherein said second machine portion is structured and arranged to transfer said tail as an endless loop.

12. The apparatus according to claim 9, wherein said second machine portion includes a narrowed section comprising one of a nip defined by a pair of calender rolls, a size press and a coating station.

13. The apparatus according to claim 9, wherein said second machine portion comprises one or more drying groups.

14. The apparatus according to claim 9, wherein said second machine portion is arranged between a last drying group and a reel up of said one of said paper machine and said finishing apparatus for said paper web.

* * * * *